US011318343B2

(12) United States Patent
Hsieh et al.

(10) Patent No.: US 11,318,343 B2
(45) Date of Patent: May 3, 2022

(54) RESISTANCE SYSTEM FOR ROWING MACHINE

(71) Applicant: Hsiao-Chieh Hsieh, Zhangzhou (CN)

(72) Inventors: Hsiao-Chieh Hsieh, Zhangzhou (CN); Chieh-Sheng Lee, Zhangzhou (CN)

(73) Assignee: Hsiao-Chieh Hsieh, Zhangzhou (CN)

( * ) Notice: Subject to any disclaimer, the term of this patent is extended or adjusted under 35 U.S.C. 154(b) by 0 days.

(21) Appl. No.: 17/002,524

(22) Filed: Aug. 25, 2020

(65) Prior Publication Data

US 2020/0384305 A1 Dec. 10, 2020

Related U.S. Application Data

(63) Continuation-in-part of application No. 16/225,041, filed on Dec. 19, 2018, now abandoned.

(51) Int. Cl.

| | |
|---|---|
| ***A63B 21/008*** | (2006.01) |
| ***A63B 21/00*** | (2006.01) |
| ***A63B 22/00*** | (2006.01) |

(52) U.S. Cl.

CPC ..... *A63B 21/0084* (2013.01); *A63B 21/4035* (2015.10); *A63B 22/0076* (2013.01); *A63B 2022/0079* (2013.01)

(58) Field of Classification Search

CPC ..... A63B 21/0084; A63B 22/0076–0089
See application file for complete search history.

(56) References Cited

U.S. PATENT DOCUMENTS 3,373,992 A * 3/1968 Ludeman ..... A63B 22/0605 482/58
3,492,147 A * 1/1970 Young ..... C09K 8/805 427/5

(Continued)

FOREIGN PATENT DOCUMENTS

CN 203253101 U 10/2013
CN 205994998 U 3/2017

(Continued)

OTHER PUBLICATIONS

Sunny Health & Fitness Obsidian Surge 500 Water Rowing Machine "https://www.amazon.com/dp/B075MB7DM8/ref=sspa_dk_detail_6?psc=1&pd_rd_i=B075MB7DM8&pd_rd_w=Uj95o&pf_rd_p=5d846283-ed3e-4512-a744-a30f97c5d738&pd_rd_wg=miteB&pf_rd_r=XKA5TMZV931W0CBJ47KS&pd_rd_r". . . Con (Year: 2017).*

(Continued)

*Primary Examiner* — Nyca T Nguyen
(74) *Attorney, Agent, or Firm* — Muncy, Geissler, Olds & Lowe, P.C.

(57) ABSTRACT

A resistance system for a rowing machine has a mounting bracket, a housing assembly, a paddle wheel, a driving assembly and a restoring assembly. The housing assembly is mounted on the mounting bracket and includes a liquid tank for storing liquid. The driving assembly is connected to the paddle wheel and drives the paddle wheel to rotate in a direction only. The restoring assembly is connected to a strip hub of the driving assembly and is able to drive the strip hub to rotate in a reverse direction. The resistance system for the rowing machine has simplified structure. Therefore, it is easy to assemble to the resistance system, and manufacturing cost of the resistance system can be decreased. In addition, a service life of the resistance system as well as the rowing machine can be increased.

15 Claims, 9 Drawing Sheets

(56) References Cited

U.S. PATENT DOCUMENTS

| | | | | | |
|---|---|---|---|---|---|
| 4,047,715 | A * | 9/1977 | Gjessing | A63B 21/157 | 482/64 |
| 4,688,791 | A * | 8/1987 | Long | A63B 22/001 | 482/112 |
| 4,743,011 | A * | 5/1988 | Coffey | A63B 21/0088 | 482/111 |
| 4,884,800 | A * | 12/1989 | Duke | A63B 21/154 | 482/73 |
| 4,940,227 | A * | 7/1990 | Coffey | A63B 22/0076 | 482/73 |
| 5,020,792 | A * | 6/1991 | Chen | A63B 21/153 | 482/127 |
| 5,665,039 | A * | 9/1997 | Wasserman | A63B 21/0084 | 482/111 |
| 5,938,551 | A * | 8/1999 | Warner | F16H 7/1263 | 474/111 |
| 7,572,211 | B2 | 8/2009 | Roach | | |
| 7,862,484 | B1 * | 1/2011 | Coffey | A63B 21/157 | 482/72 |
| 9,610,474 | B1 * | 4/2017 | Carlsen | A63B 21/0084 | |
| 9,945,383 | B2 * | 4/2018 | Wang | A63B 21/0051 | |
| 10,376,735 | B2 * | 8/2019 | Bates | A63B 21/00192 | |
| 10,441,834 | B2 | 10/2019 | Liu et al. | | |
| 10,493,310 | B2 | 12/2019 | King | | |
| 10,556,167 | B1 | 2/2020 | Machovina et al. | | |
| 2005/0014611 | A1 * | 1/2005 | Gearon | A63B 22/0605 | 482/73 |
| 2007/0197347 | A1 * | 8/2007 | Roach | A63B 22/0076 | 482/72 |
| 2009/0285633 | A1 * | 11/2009 | Benham | A63B 69/125 | 405/79 |
| 2012/0071302 | A1 * | 3/2012 | Donne | A63B 21/0084 | 482/58 |
| 2012/0277071 | A1 * | 11/2012 | Lin | A63B 21/4045 | 482/111 |
| 2013/0225375 | A1 * | 8/2013 | Lumsden | A63B 22/0076 | 482/72 |
| 2015/0057130 | A1 * | 2/2015 | Lin | A63B 22/0076 | 482/72 |
| 2015/0273266 | A1 * | 10/2015 | Lo | A63B 21/4035 | 482/114 |
| 2017/0209729 | A1 * | 7/2017 | King | A63B 21/4045 | |
| 2018/0056118 | A1 * | 3/2018 | Bates | A63B 69/06 | |
| 2019/0118021 | A1 * | 4/2019 | Liu | A63B 21/0084 | |

FOREIGN PATENT DOCUMENTS

| | | | |
|---|---|---|---|
| CN | 206167841 | U | 5/2017 |
| CN | 206434774 | U | 8/2017 |
| CN | 207477860 | U | 6/2018 |
| CN | 207605300 | U | 7/2018 |
| EP | 3492147 | A1 | 6/2019 |
| WO | WO-2019/033244 | A1 | 2/2019 |

OTHER PUBLICATIONS

Con.."=6b966e51-5c9a-48d7-9dd8-50ec6c1741ae&spLa=ZW5jcnlwdGVkUXVhbGlmaWVyPUEzVUVDSTIWOEhBN0hHJmVuY3J5cHRIZEIkPUEwMDI3MjIyMVVNMzAxOEpZNVIRWCZIbmNyeXB0ZWRBZEIkPUEwODY4MTI5MTdaTjhKMEQ0UDVMViZ3aWRnZXROYW1IPXNwX2RldGFpbF90aGVtYXRpYyZhY3Rpb24 9Y2xpY2tSZWRpcmVjdCZkb05vdExvZ0NsaWNrPXRydWU=" Oct. 20, 2017 (Year: 2017).*

Merax Water Rowing Machine—Fitness Indoor Water Rower with LCD Monitor Home Gym Equipment "https://www.amazon.com/dp/B07LBTC23M/ref=sspa_dk_detail_1?psc=1&pd_rd_i=B07LBTC23M&pd_rd_w=5Bk3q&pf_rd_p=5d846283-ed3e-4512-a744-a30f97c5d738&pd_rd_wg=cflx9&pf_rd_r=P7GYG3N2GZ4ASSJ9W6DM&pd_rd_r". . . Con (Year: 2018).*

Con.."=c0ee6de9-7fb8-4f4f-8946-41588b3b7bb2&spLa=ZW5jcnlwdGVkUXVhbGlmaWVyPUEzSUVBOVZCQ0dlODNCJmVuY3J5cHRIZEIkPUEwMjQ5MDU2MzQ0SVNWM05BNTg1QiZlbmNyeXB0ZWRBZEIkPUEwMzMyNTg3MINBNFJFNTI3VzBFUSZ3aWRnZXROYW1IPXNwX2RldGFpbF90aGVtYXRpYyZhY3Rpb249Y2xpY2tSZWRpcmVjdCZkb05vdExvZ0NsaWNrPXRydWU=" Dec. 13, 2018 (Year: 2018).*

First Degree Fitness Rowing Machine "https://www.amazon.com/First-Degree-Fitness-Rowing-Machine/dp/B015UGTBNA/ref=sr_1_6?crid=2XWNYB3OPIAQZ&dchild=1&keywords=first+degree+rowing+machine&qid=1630130023&s=sporting-goods&sprefix=first+degree+rowing%2Csporting%2C212&sr=1-6" Dec. 26, 2015 (Year: 2015).*

* cited by examiner

RESISTANCE SYSTEM FOR ROWING MACHINE

The present application is a continuation-in-part application claiming the benefit of U.S. non-provisional application Ser. No. 16/225,041, filed on Dec. 19, 2018, which is incorporated herein by reference in its entirety.

BACKGROUND OF THE INVENTION

Field of the Invention

The present invention relates to an exercise equipment, especially to a resistance system for a rowing machine.

Description of the Related Art

Rowing is an interesting and challenging sport, which exercises all the major muscle groups including quadriceps femoris, biceps, triceps, latissimus dorsi, gluteal, and abdominal muscles. A rowing machine is an exercise equipment that is used to simulate action of the rowing for the purpose of exercise and training the muscles groups.

A conventional resistance system for a rowing machine includes a magnetic brake and an elastic rope. The elastic rope is connected to the magnetic brake and is able to resume its original shape after being stretched. An exerciser pulls the elastic rope repeatedly and resists resistance force formed by the magnetic brake and elasticity of the elastic rope, so as to achieve exercise and training effects.

However, a structure of the magnetic brake is complex and needs high manufacturing cost. Moreover, after being stretched repeatedly, elastic fatigue occurs in the elastic rope. Consequently, the exercise and training effects of the rowing machine having the conventional resistance system are greatly influenced.

SUMMARY OF THE INVENTION

To overcome the shortcomings, the present invention provides a resistance system for a rowing machine to mitigate or obviate the aforementioned problems.

An embodiment of the present invention discloses a resistance system for a rowing machine. The resistance system has a mounting bracket, a housing assembly, a paddle wheel, a driving assembly, and a restoring assembly.

The housing assembly is mounted on the mounting bracket and includes a liquid tank. The liquid tank is for storing liquid and has two opposite side walls.

The paddle wheel is mounted in the liquid tank and has a rotating base, multiple paddle blades, and a driven shaft. The paddle blades include a first set of paddle blades and a second set of paddle blades. The first set of paddle blades is erected on and surrounding a first side of the rotating base at intervals. The second set of paddle blades is erected on and surrounding a second side, opposite the first side, of the rotating base at intervals. The driven shaft protrudes from a center of the rotating base and is rotatably mounted through one of the side walls of the liquid tank.

The rotating base includes a center part, a ring and a plurality of ribs. The first set of the paddle blades and the second set of the paddle blades are respectively mounted on the opposite sides of the ring. Each of the ribs connects the ring and the center part. Fixed positions of the first set of the paddle blades and fixed positions of the second set of the paddle blades at the rotating base are staggered.

The driving assembly is mounted on the driven shaft and includes a strip hub, at least one one-way bearing, a driving strip, and a handle. The strip hub is mounted around the driven shaft and has a connecting axle protruding from an end surface of the strip hub and being coaxial with the driven shaft. The at least one one-way bearing is mounted between and is connected to the driven shaft and the strip hub. The driving strip is wound around the strip hub. The handle is connected with the driving strip. The driving strip is adapted to make the paddle wheel and the liquid tank relatively rotating.

The restoring assembly is mounted around the connecting axle of the strip hub and includes a casing and a restoring element. The casing is securely connected to the mounting bracket and is mounted around the connecting axle. The restoring element is resilient, is mounted in the casing, and has two ends respectively connected to the casing and the connecting axle.

The liquid tank is inclined to the ground in a using status of the rowing machine. The mounting bracket includes an angle-adjusting assembly adapted to change the angle between the liquid tank and the ground in the using status of the rowing machine.

Another embodiment of the present invention discloses that the liquid tank further has an annular wall connected to the two side walls to form the shell of the liquid tank with the side walls, and the housing assembly further has two baffles disposed in the liquid tank and attached to the two side walls of the liquid tank respectively. Each of the baffles is annular and has a gap defined through the baffle, and an interior of the liquid tank is divided into an inner compartment surrounded by the baffles and an outer compartment formed between the annular wall of the liquid tank and the baffles. The rotating base is rotatably disposed between the baffles. The paddle blades is disposed in the outer compartment of the liquid tank and protruding toward the two side walls.

The resistance system for the rowing machine has simplified structure. Therefore, it is easy to assemble to the resistance system, and manufacturing cost of the resistance system can be decreased. In addition, a service life of the resistance system as well as the rowing machine can be increased.

Other objectives, advantages and novel features of the invention will become more apparent from the following detailed description when taken in conjunction with the accompanying drawings.

DETAILED DESCRIPTION OF THE INVENTION

Figure 1:
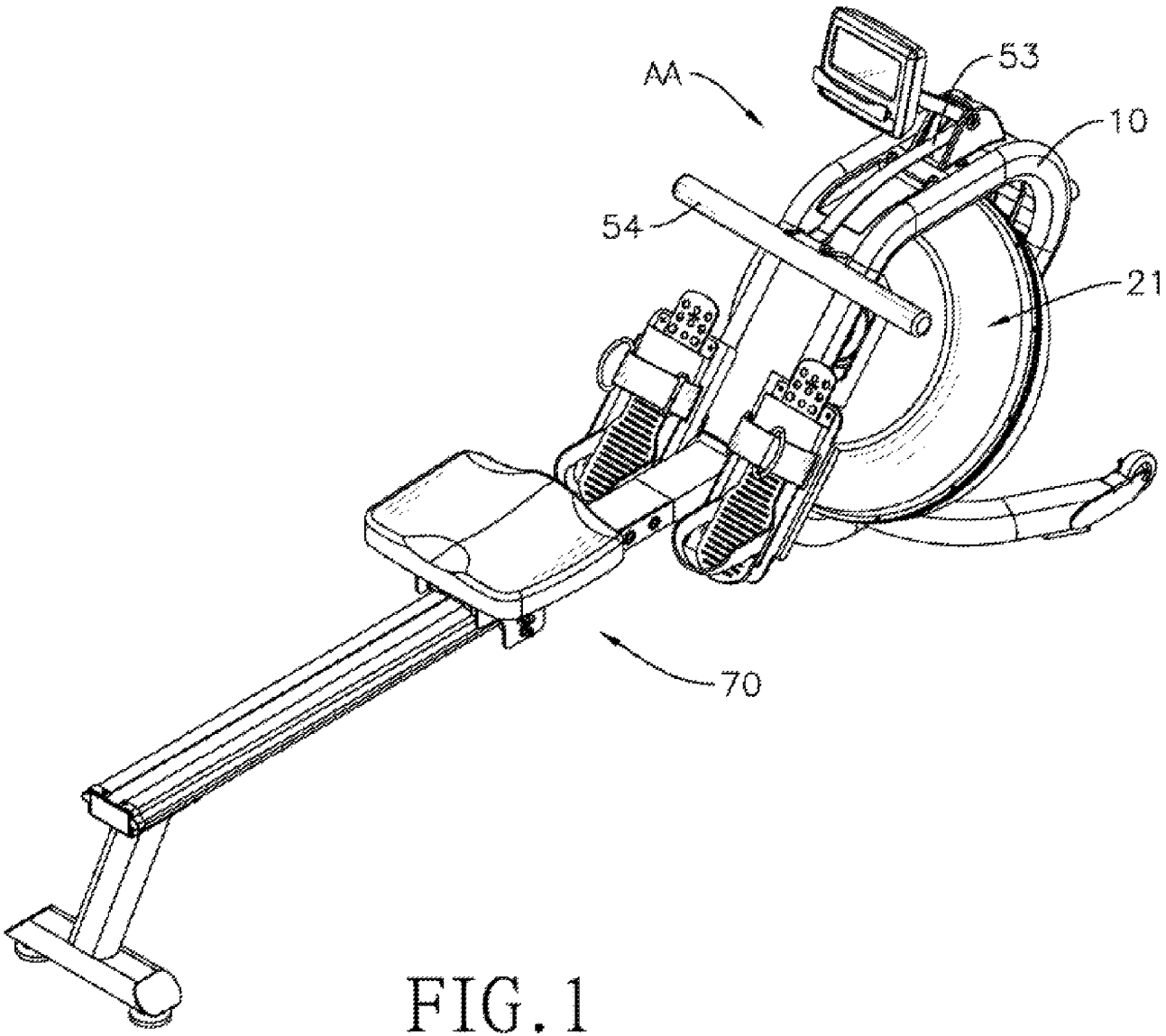
FIG. 1 is a using perspective view of a resistance system for a rowing machine in accordance with an embodiment of the invention.

With reference to FIGS. 1 to 4, a resistance system AA for a rowing machine includes a mounting bracket 10, a housing assembly 20, a paddle wheel 30, at least one strip guiding member 40A, 40B, a driving assembly 50, and a restoring assembly 60.

The mounting bracket 10 is connected to a front end of a seat assembly 70 of the rowing machine.

Figure 2:
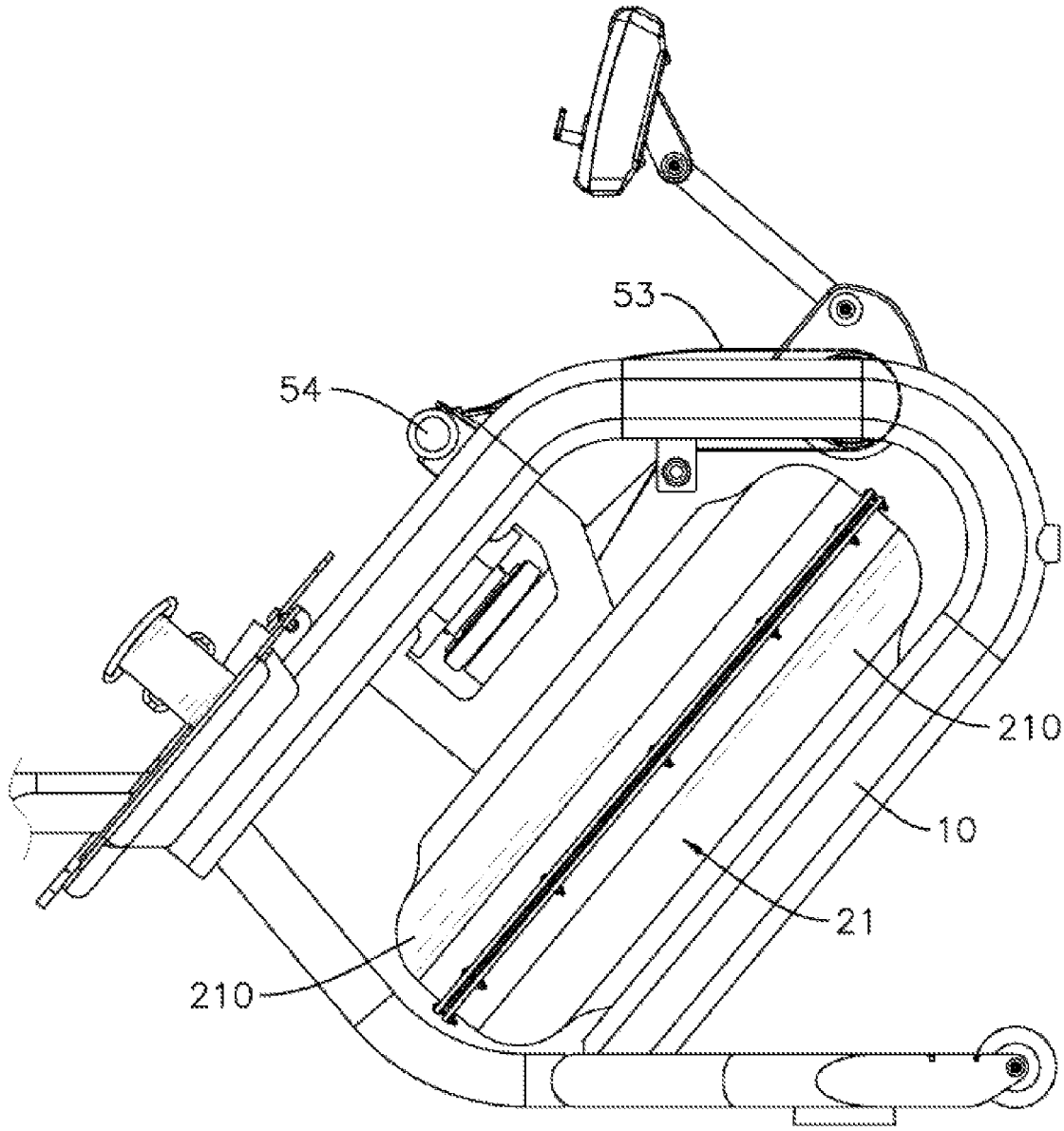
FIG. 2 is a side perspective view of the resistance system in FIG. 1.
Figure 3:
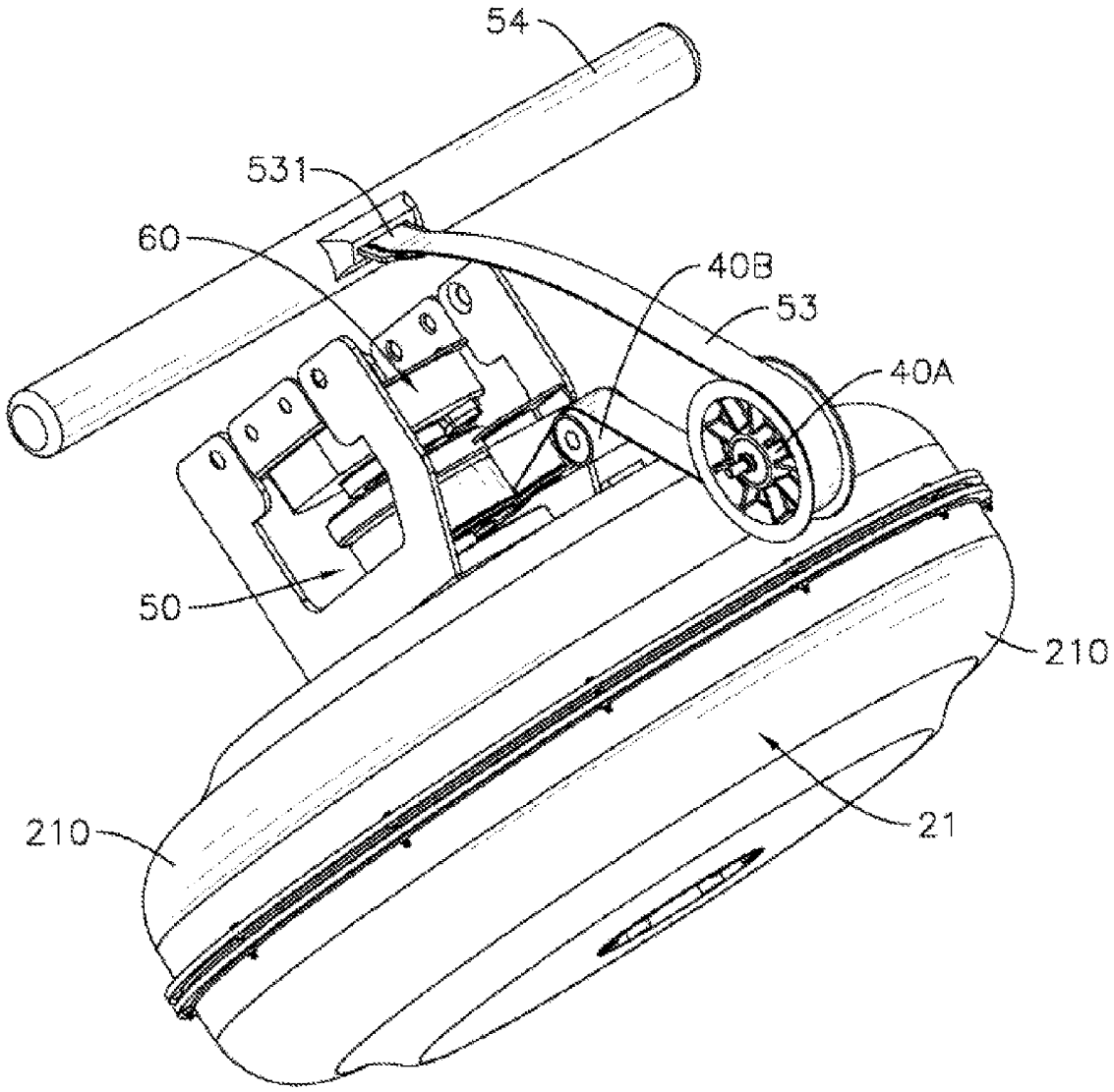
FIG. 3 is a top perspective view of the resistance system in FIG. 1, with a mounting bracket shown omitted.
Figure 5:
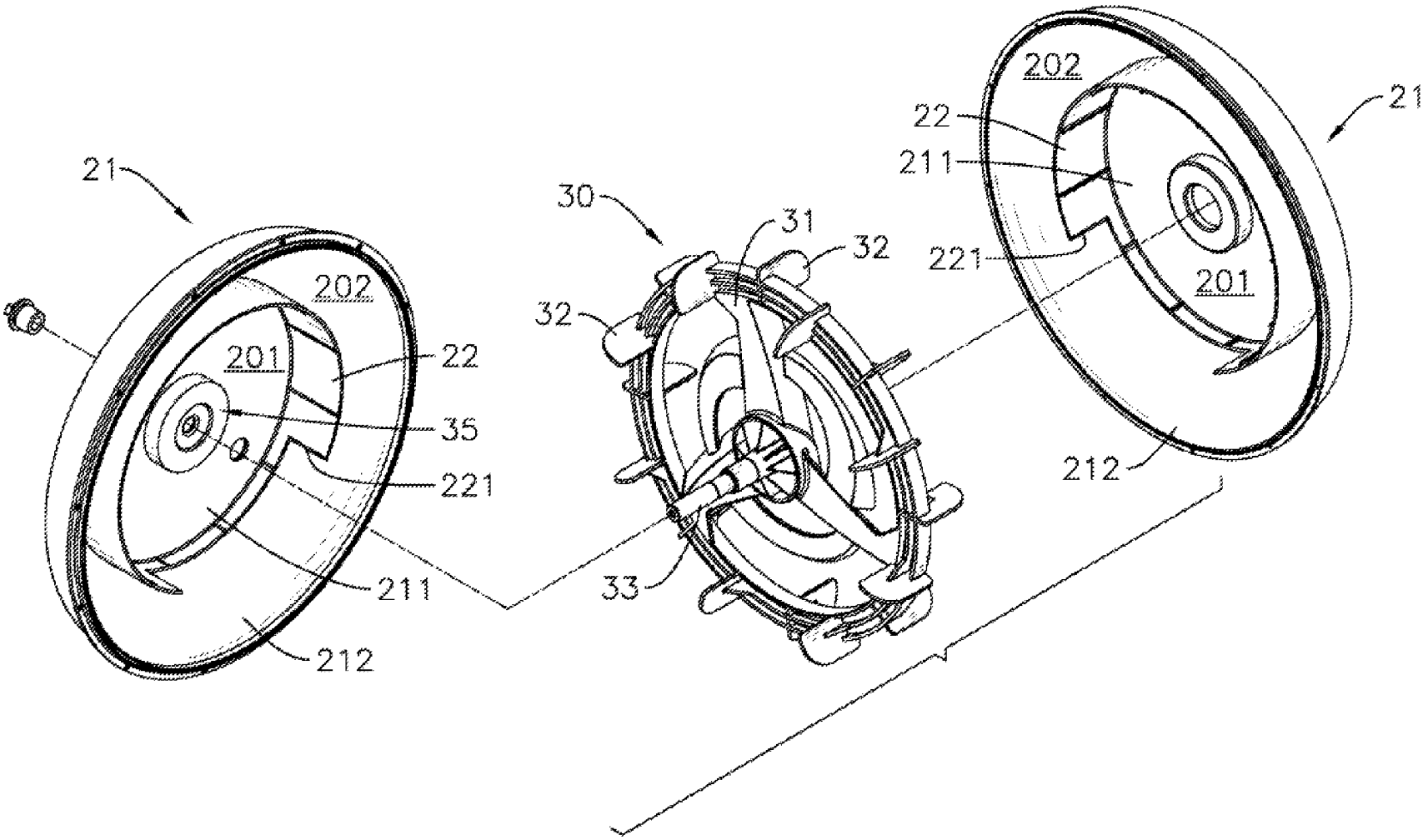
FIG. 5 is an exploded perspective view of a housing assembly and a paddle wheel of the resistance system in FIG. 1.

With further reference to FIGS. 2 and 5, the housing assembly 20 is mounted on the mounting bracket 10 and includes a liquid tank 21 and two baffles 22.

The liquid tank 21 is for storing liquid such as water, and has two side walls 211 and an annular wall 212. The side walls 211 are oppositely defined on the liquid tank 21. The annular wall 212 is formed between the two side walls 211 and connected to the two side walls 211 to form the shell of the liquid tank 21 with the side walls 211. One of the side walls 211 faces the user in a using status of the rowing machine, which shortens the overall length and facilitates placement of the rowing machine.

The baffles 22 are disposed in the liquid tank 21 and are attached to the two side walls 211 of the liquid tank 21 respectively. Each of the baffles 22 is annular and has a gap 221 defined through the baffle 22. An interior of the liquid tank 21 is divided into an inner compartment 201 surrounded by the baffles 22 and an outer compartment 202 formed between the annular wall 212 of the liquid tank 21 and the baffles 22. The inner compartment 201 and the outer compartment 202 in the liquid tank 21 communicates with each other via the gaps 221 of the baffles 22.

In the embodiment, the liquid tank 21 is formed by attaching two half-housings 210 in a watertight manner. The gap 221 of one of the baffles 22 corresponds in position to the gap 221 of the other baffle 22.

Figure 4:
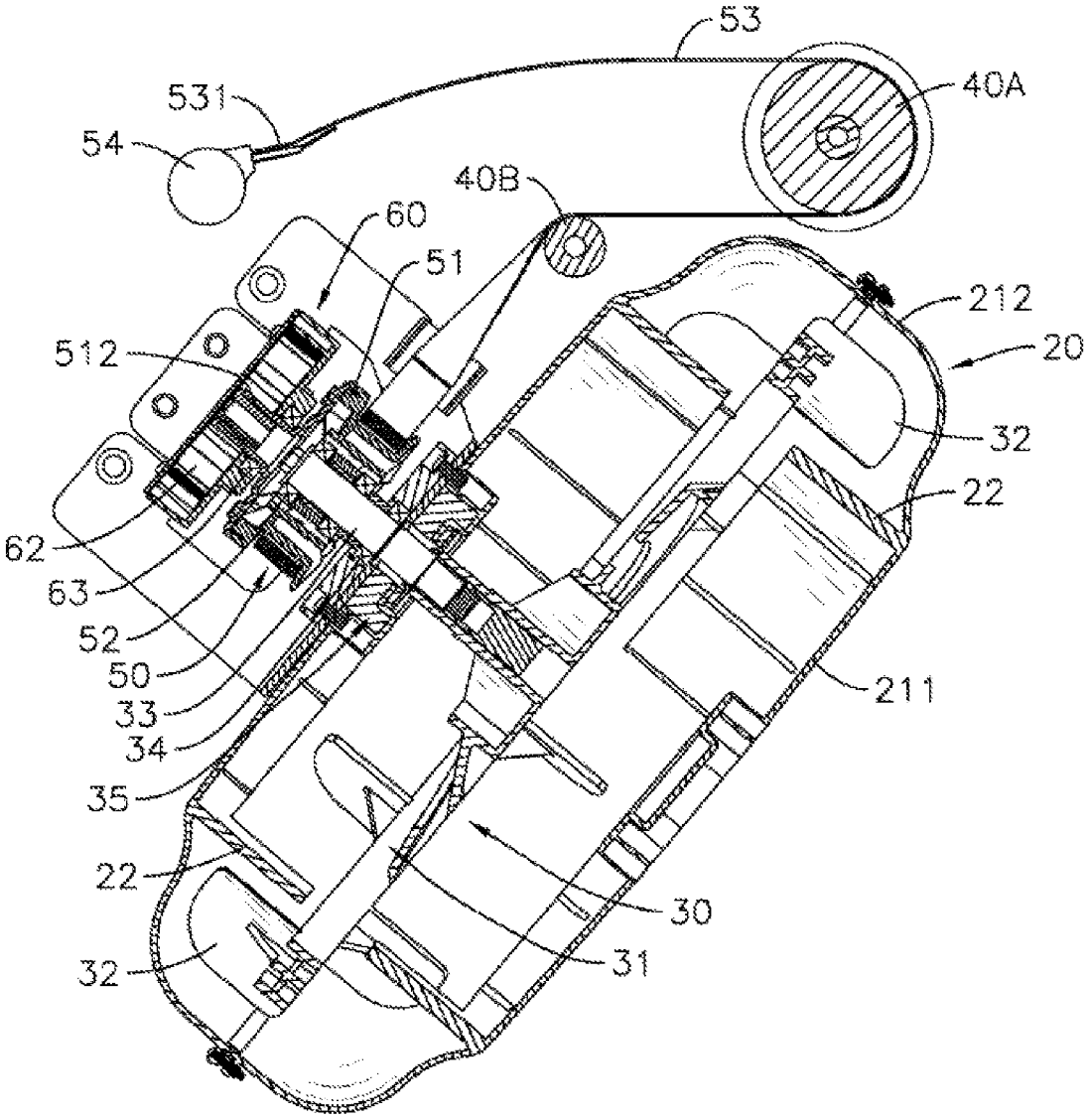
FIG. 4 is a cross-sectional side view of the resistance system in FIG. 1, with the mounting bracket shown omitted.

With further reference to FIG. 4, the paddle wheel 30 is mounted in the liquid tank 21 and has a rotating base 31, multiple paddle blades 32, and a driven shaft 33. The rotating base 31 is substantially formed as a circular plate and is rotatably disposed between the baffles 22. The paddle blades 32 are formed on and surround the rotating base 31 at intervals, are disposed in the outer compartment 202 of the liquid tank 21, and alternately protrude toward the two side walls 211. The driven shaft 33 protrudes from a center of the rotating base 31, is rotatably mounted through one of the side walls 211 of the liquid tank 21, and has an outer end protruding out of the liquid tank 21.

Preferably, the liquid tank 21 is connected to the driven shaft 33 via at least one bearing 34 thereof, such that the driven shaft 33 is able to rotate smoothly and stably relative to the liquid tank 21. Preferably, at least one sealing member 34 is mounted between the liquid tank 21 and the driven shaft 33, so as to avoid leakage of the liquid in the liquid tank 21.

The at least one strip guiding member 40A, 40B is mounted on the mounting bracket 10. In an embodiment, each of the at least one strip guiding member 40A, 40B is cylindrical.

Figure 6:
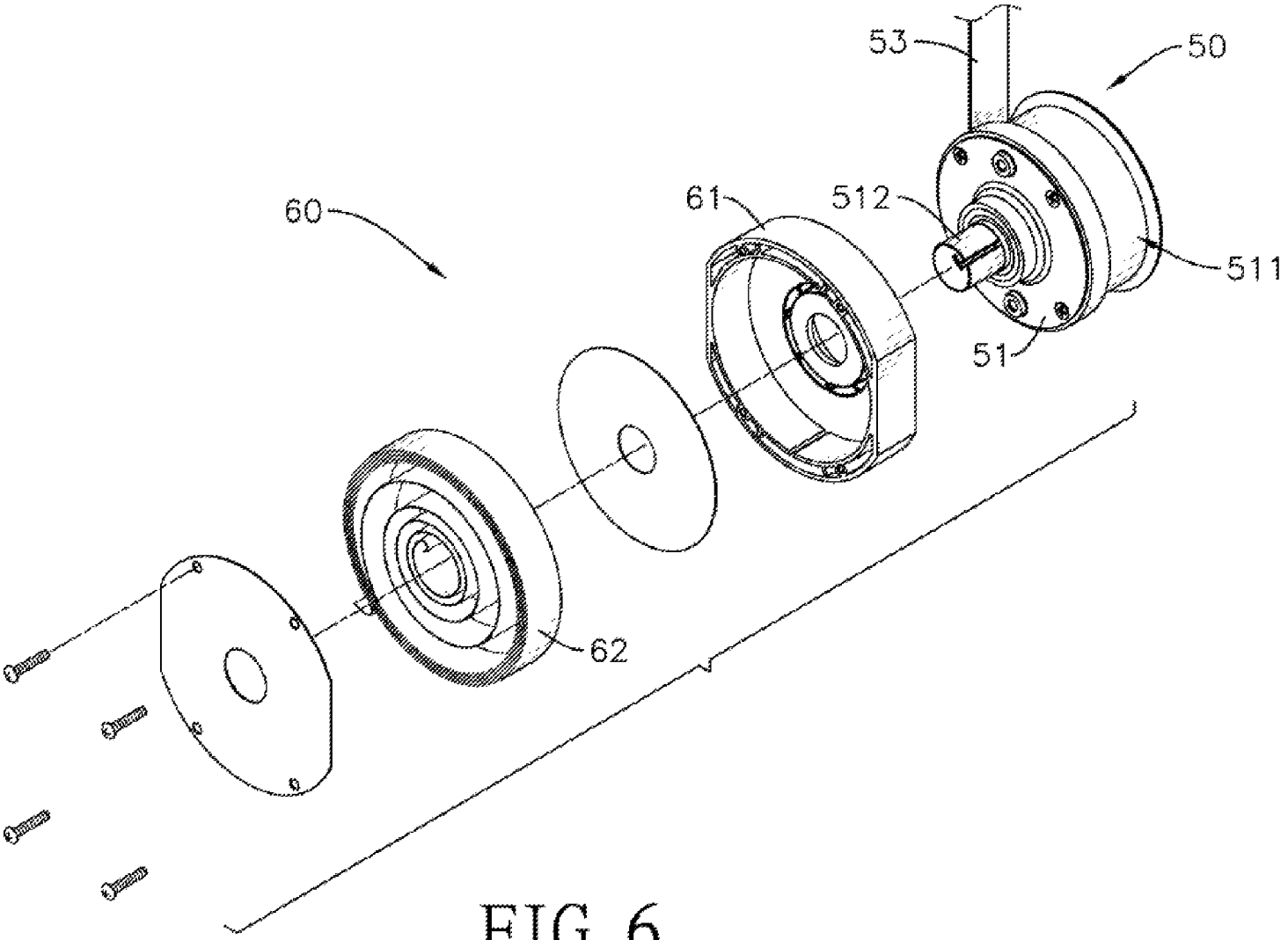
FIG. 6 is an exploded perspective view of a driving assembly and a restoring assembly of the resistance system in FIG. 1.

With further reference to FIGS. 4 and 6, the driving assembly 50 is mounted on the outer end of the driven shaft 33 of the paddle wheel 30 and includes a strip hub 51, at least one one-way bearing 52, a driving strip 53, and a handle 54.

The strip hub 51 is mounted around the outer end of the driven shaft 33 and has an annular recess 511 and a connecting axle 512. The annular recess 511 is formed in and around an annular side surface of the strip hub 51. The connecting axle 512 protrudes from an end surface of the strip hub 51 and is coaxial with the driven shaft 33. The at least one one-way bearing 52 is mounted between and is connected to the driven shaft 33 and the strip hub 51.

The driving strip 53 is adapted to make the paddle wheel 30 and the liquid tank 21 relatively rotating. The driving strip 53 is wound around the strip hub 51 in the annular recess 511, abuts against and is oriented by the at least one strip guiding member 40A, 40B, and has an inner connecting end and an outer pulling end 531. The inner connecting end of the driving strip 53 is connected with the strip hub 51. The outer pulling end 531 of the driving strip 53 extends toward the seat assembly 70. The handle 54 is connected with the outer pulling end 531 of the driving strip 53.

With the at least one one-way bearing 52 disposed between the driven shaft 33 and the strip hub 51, when the strip hub 51 is driven to rotate to unwind the driving strip 53, the strip hub 51 drives the driven shaft 33, i.e. the paddle wheel 30, to rotate; when the strip hub 51 is driven to rotate to wind the driving strip 53, the strip hub 51 is free from driving the driven shaft 33, i.e. the paddle wheel 30, to rotate.

The restoring assembly 60 is mounted around the connecting axle 512 of the strip hub 51 and includes a casing 61 and a restoring element 62. The casing 61 is securely connected to the mounting bracket 10 and is mounted around the connecting axle 512, such that the connecting axle 512 protrudes into the casing 61. The restoring element 62 is resilient, is mounted in the casing 61, and has two ends respectively connected to the casing 61 and the connecting axle 512.

Preferably, the casing 61 is connected to the connecting axle 512 via at least one bearing 63 thereof. In an embodiment, the restoring element 62 is a volute spring that is wound around the connecting axle 512 of the strip hub 51.

When using the rowing machine, a user sits on the seat assembly 70, faces toward the resistance system AA, and holds the handle 54 of the driving assembly 50.

As the user pulls the driving strip 53 to unwind the driving strip 53, the strip hub 51 is driven to rotate to make the paddle wheel 30 rotated. Meanwhile, a resilient restoring force of the restoring element 62 is formed, and the connecting axle 512 of the strip hub 51 is rotated in a direction. Turbulence caused by the paddle blades 32 moving the liquid in the liquid tank 21 provides fluid resistance to rotation of the wheel paddle 30. Moreover, the liquid pushed by the paddle blades 32 of the paddle wheel 30 flows in the outer compartment 202 and is guided toward the liquid level at balance by the baffles 22 in the liquid tank 21, which reduces the vibration of the liquid tank 21.

As the user releases the driving strip 53, the restoring element 62 drives the strip hub 51 to rotate reversely to wind the driving strip 53. With the at least one one-way bearing 52 disposed between the driven shaft 33 and the strip hub 51, the strip hub 51 is free from driving the paddle wheel 30 to rotate. Thus, the fluid resistance does not hinder rotation of the strip hub 51.

The resistance system AA for the rowing machine as described has simplified structure. Therefore, it is easy to assemble to the resistance system AA, and manufacturing cost of the resistance system AA can be decreased. In addition, a service life of the resistance system AA as well as the rowing machine can be increased.

Figure 7:
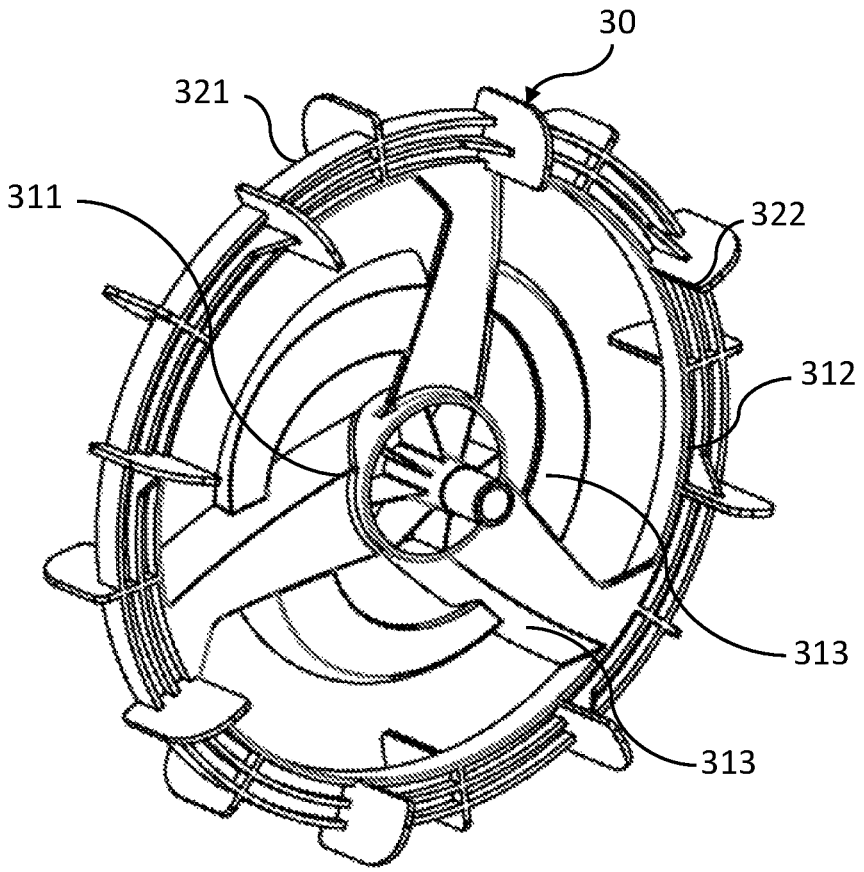
FIG. 7 is a schematic view of a paddle wheel of the resistance system in FIG. 1.

With reference to FIG. 7, the paddle blades 32 includes a first set of paddle blades 321 and a second set of paddle blades 322. The first set of paddle blades 321 is erected on and surrounds a first side of the rotating base 31 at intervals. The second set of paddle blades 322 is erected on and surrounds a second side, opposite the first side, of the rotating base 31 at intervals. The rotating base 31 includes a center part 311, a ring 312 and a plurality of ribs 313. The first set of the paddle blades 321 and the second set of the paddle blades 322 are respectively mounted on the opposite sides of the ring 312. Each of the ribs 313 connects the ring 312 and the center part 311 to strengthen the overall structure of the paddle wheel 30. The fixed positions of the first set of the paddle blades 321 and the fixed positions of the second set of the paddle blades 322 at the ring 312 of the rotating base 31 are staggered. With the ring 312 and the staggered structure of the paddle blades 32, the liquid tank 21 is less vibrated and more stable when the paddle wheel 30 is rotated.

Figure 8:
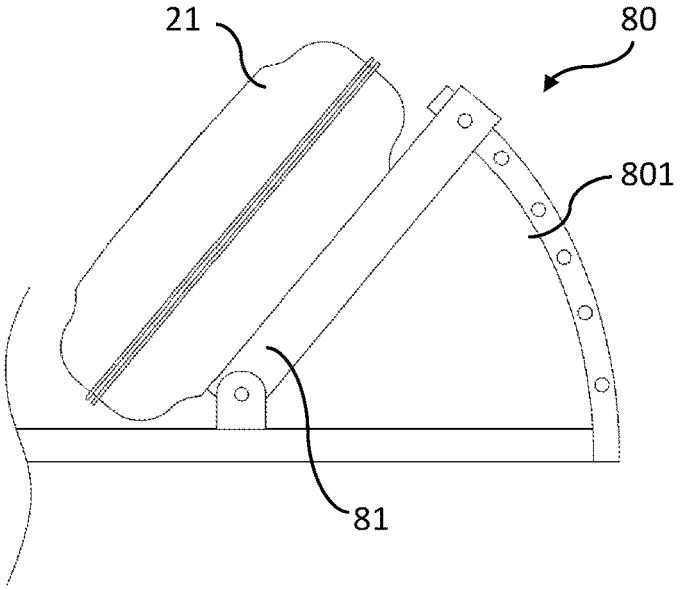
FIG. 8 is a side schematic view of an angle-adjusting assembly of the resistance system in accordance with an embodiment of the invention.
Figure 9:
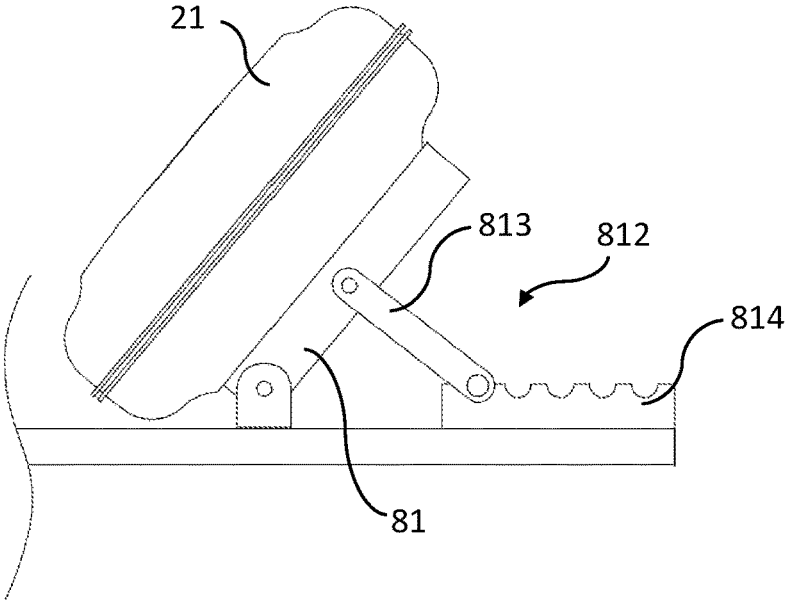
FIG. 9 is a side schematic view of an angle-adjusting assembly of the resistance system in accordance with an embodiment of the invention.
Figure 10:
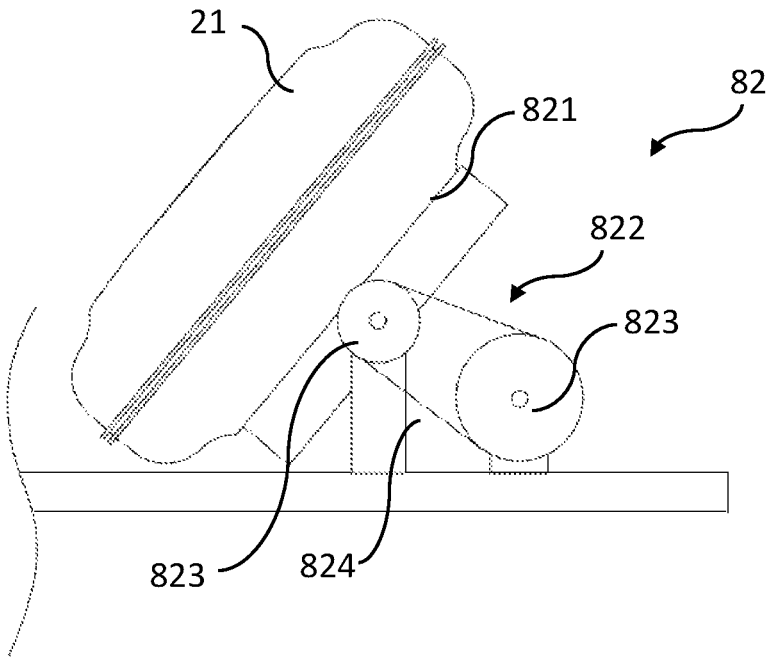
FIG. 10 is a side schematic view of an angle-adjusting assembly of the resistance system in accordance with an embodiment of the invention.

With reference to FIGS. 8 to 10, in an embodiment, the mounting bracket 10 includes an angle-adjusting assembly 80, 82 adapted to change the angle between the liquid tank 21 and the ground in the using status of the rowing machine. The liquid tank 21 is inclined to the ground in the using status of the rowing machine, and the angle between the liquid tank 21 and the ground is adjustable by the angle-adjusting assembly 80, 82. By adjusting the angle between the liquid tank 21 and the ground, the angle and degree of the paddle blades 32 pushing the liquid in the liquid tank 21 is changed accordingly, resulting that the resistance force produced by the resistance system AA in the embodiment of the invention is changeable and adjustable in an approaching linear way with the angle between the liquid tank 21 and the ground.

With reference to FIG. 8, the angle-adjusting assembly 80 includes a bearing frame 811 carrying the liquid tank 21 and a lifting mechanism 801 connected to the bearing frame 811. One end of the bearing frame 811 is pivoted to the mounting bracket. The distance between another end of the bearing frame 811 and the ground is changeable by the lifting mechanism 801. The lifting mechanism 801 is an arced positioning bar 801. The arced positioning bar 801 has multiple holes at intervals therein. The other end of the bearing frame 811 is fixed to one of the holes depending on the resistance force of the resistance system AA or the angle between the liquid tank 21 and the ground, the user wanted.

With reference to FIG. 9, it shows the lifting mechanism 812 can include a rod 813 and a rack 814. One end of the rod 813 is pivoted to the bearing frame 811. The other end of the rod 813 is placed into one of the indentations of the rack 814, depending on the resistance force of the resistance system AA or the angle between the liquid tank 21 and the ground, the user wanted. In another embodiment, the other end of the rod 813 can be pivoted to an eccentric wheel, instead of the rack 814, to achieve the same purpose. The lifting mechanism 812 can also be a gas spring. Two ends of the gas spring are respectively pivoted to the bearing frame 811 and the mounting bracket.

With reference to FIG. 10, the angle-adjusting assembly 82 includes a bearing frame 821 carrying the liquid tank 21 and a rotating mechanism 822 connected to the bearing frame 821. The bearing frame 821 is rotatable by the rotating mechanism 822. The rotating mechanism 822 includes two gears 823 and a belt 824 surrounding the gears 823. One of the gears 823 is fixed to the bearing frame 821, and the other gear 823 is connected rotatably to the mounting bracket. In another embodiment, the two gears 823 can engage with each other, instead of the belt 824.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A resistance system for a rowing machine comprising:
- a mounting bracket;
- a housing assembly mounted on the mounting bracket and including a liquid tank, for storing liquid, having two opposite side walls, wherein the liquid tank is inclined to the ground in a using status of the rowing machine;
- a paddle wheel mounted in the liquid tank and having:
  - a rotating base; and
  - a plurality of paddle blades formed on and surrounding the rotating base at intervals; and
- a driving assembly, mounted on the paddle wheel, including:
  - a driving strip adapted to make the paddle wheel and the liquid tank relatively rotating; and
  - a handle connected with the driving strip;
- wherein the mounting bracket includes an angle-adjusting assembly adapted to change the angle between the liquid tank and the ground in the using status of the rowing machine.

2. The resistance system as claimed in claim 1, wherein the paddle wheel further includes a driven shaft protruding from a center of the rotating base, rotatably mounted through one of the side walls of the liquid tank, and having an outer end protruding out of the liquid tank, and the driving assembly is mounted on the outer end of the driven shaft.

3. The resistance system as claimed in claim 2, wherein the driving assembly further includes:
- a strip hub mounted around the outer end of the driven shaft and having a connecting axle, and the connecting axle protruding from an end surface of the strip hub and being coaxial with the driven shaft; and
- at least one one-way bearing mounted between and connected to the driven shaft and the strip hub,
- wherein the driving strip is wound around the strip hub and has an inner connecting end connected with the strip hub and an outer pulling end connected with the handle.

4. The resistance system as claimed in claim 3, further comprising a restoring assembly mounted around the connecting axle of the strip hub and including:
- a casing securely connected to the mounting bracket and mounted around the connecting axle; and
- a restoring element being resilient, mounted in the casing, and having two ends respectively connected to the casing and the connecting axle.

5. The resistance system as claimed in claim 4, wherein the liquid tank is connected to the driven shaft of the paddle wheel via at least one bearing thereof, and the casing of the restoring assembly is connected to the connecting axle of the strip hub via at least one bearing thereof.

6. The resistance system as claimed in claim 3, further comprising:

at least one strip guiding member mounted on the mounting bracket, wherein the driving strip abuts against and is oriented by the at least one strip guiding member.

7. The resistance system as claimed in claim 1, wherein the paddle blades include:

a first set of paddle blades erected on and surrounding a first side of the rotating base at intervals; and a second set of paddle blades erected on and surrounding a second side, opposite the first side, of the rotating base at intervals.

8. The resistance system as claimed in claim 7, wherein the rotating base includes a center part, a ring and a plurality of ribs, the first set of the paddle blades and the second set of the paddle blades are respectively mounted on the opposite sides of the ring, and each of the ribs connects the ring and the center part.

9. The resistance system as claimed in claim 8, wherein fixed positions of the first set of the paddle blades and fixed positions of the second set of the paddle blades on the rotating base are staggered.

10. The resistance system as claimed in claim 1, wherein the liquid tank further has an annular wall to form the shell of the liquid tank with the side walls, the annular wall connects the side walls, and one of the side walls faces the user in the using status of the rowing machine.

11. The resistance system as claimed in claim 1, wherein the angle-adjusting assembly includes a bearing frame carrying the liquid tank and a lifting mechanism connected to the bearing frame, one end of the bearing frame is pivoted to the mounting bracket, and the distance between another end of the bearing frame and the ground is changeable by the lifting mechanism.

12. The resistance system as claimed in claim 1, wherein the angle-adjusting assembly includes a bearing frame carrying the liquid tank and a rotating mechanism connected to the bearing frame, and the bearing frame is rotatable by the rotating mechanism.

13. A resistance system for a rowing machine comprising:

a mounting bracket;

a housing assembly mounted on the mounting bracket and including:

a liquid tank, for storing liquid, having two opposite side walls and an annular wall connected to the two side walls to form the shell of the liquid tank with the side walls; and two baffles disposed in the liquid tank and attached to the two side walls of the liquid tank respectively, wherein each of the baffles is annular and has a gap defined through the baffle, and an interior of the liquid tank is divided into an inner compartment surrounded by the baffles and an outer compartment formed between the annular wall of the liquid tank and the baffles;

a paddle wheel mounted in the liquid tank and having:

a rotating base rotatably disposed between the baffles; and a plurality of paddle blades formed on and surrounding the rotating base at intervals, disposed in the outer compartment of the liquid tank and protruding toward the two side walls; and a driving assembly, mounted on the paddle wheel, including:

a driving strip adapted to make the paddle wheel and the liquid tank relatively rotating; and a handle connected with the driving strip;

wherein the angle between the liquid tank and the ground is adjustable in a using status of the rowing machine by an angle-adjusting assembly of the mounting bracket.

14. The resistance system as claimed in claim 13, wherein the paddle blades include a first set of paddle blades and a second set of paddle blades, the rotating base includes a center part, a ring and a plurality of ribs, the first set of the paddle blades and the second set of the paddle blades are respectively mounted on the opposite sides of the ring, and each of the ribs connects the ring and the center part.

15. The resistance system as claimed in claim 14, wherein fixed positions of the first set of the paddle blades and fixed positions of the second set of the paddle blades on the rotating base are staggered.

* * * * *